United States Patent [19]

Crosby et al.

[11] 4,155,616

[45] May 22, 1979

[54] CATHODE RAY TUBE BASE

[75] Inventors: Alton L. Crosby; Joseph N. Debernardis, both of Seneca Falls, N.Y.

[73] Assignee: GTE Sylvania Incorporated, Stamford, Conn.

[21] Appl. No.: 887,548

[22] Filed: Mar. 17, 1978

[51] Int. Cl.[2] ..... H01R 33/76

[52] U.S. Cl. ..... 339/144 T; 313/318

[58] Field of Search ..... 339/144 T, 145 T; 313/318

[56] References Cited

U.S. PATENT DOCUMENTS

| | | | |
|---|---|---|---|
| 2,788,503 | 4/1957 | Millis | 339/145 T |
| 4,040,707 | 8/1977 | Pisano | 313/318 X |
| 4,040,708 | 8/1977 | Neuber et al. | 313/318 X |
| 4,127,313 | 11/1978 | Marks | 339/144 T |

*Primary Examiner*—Roy Lake
*Assistant Examiner*—E. F. Desmond
*Attorney, Agent, or Firm*—William H. McNeill

[57] ABSTRACT

There is provided a cathode ray tube-base combination wherein a resilient electrically insulating insert is incorporated to provide arc prevention between adjacent tube pins having a high electrical potential difference therebetween. The resilient insert has discretely contoured surfaces formed to provide arc inhibiting barriers when compressively mated with the respective tube closure and base member.

4 Claims, 5 Drawing Figures

CATHODE RAY TUBE BASE

BACKGROUND OF THE INVENTION

This invention relates to a cathode ray tube and base therefor and more particularly to improved means for achieving better insulation in tube bases wherein there exists high voltage differentials between related tube pins.

Advancement in cathode ray tube technology, in particular the tube types employed in color television applications, has resuited in the development of efficient compacted electron gun structures. In keeping with conventional tube construction, these miniaturized gun assemblies are oriented within tube envelope neck portions of reduced diameters. The necessary operating voltages for the various elements of these guns (heaters, cathodes, accelerating and focusing electrodes, etc.) are supplied via an annular array of connector pins sealed into and projecting from the header or stem closure portion of the tube. As the neck diameters of the tube envelopes become smaller, the circumferential spacings between the connector pins likewise decreases.

Prior art tubes have evidenced large voltage differentials between certain of the pins in the connector array. This differential, sometimes in the order of 5 KV to 12 KV, has necessitated the incorporation of some form of arc protection into the tube socket, see, for example, U.S. Pat. Nos. 3,466,491 and 3,446,492. Such protection, however, has proven to be incapable of providing adequate arc protection for the newer tube types.

Another procedure previously employed, in conjunction with the base of the tube, involved the manual dispensing of a viscous silicone material about a high voltage pin, e.g., the focusing electrode connection, to efffect better electrical isolation from adjacent pins. This process was troublesome because of the long time required for curing the silicone and the need for additional labor to dispense the material. Furthermore, the manual application of the silicone tended to cause bubbles or air pockets to form therin, thus diminishing the intended arcing protection in the tube-base combination.

A more recent technique is that set-forth in U.S. Pat. No. 4,040,404, which is assigned to the assignee of the present invention. This patent discloses a cathode ray tube base wherein at least one tube pin isolating means is formed within the base member to provide arc prevention between adjacent tube pins. The disclosed isolation or arc prevention means comprises a cut-out portion in the base member, wherein a flat electrically insulating plug, having a cylindrical pin-engaging aperture therethrough and adhesive on both sides, is placed within the cut-out recess. While this means reduces the arcing problem to a degree, the presence of adhesive on both flat surfaces of the plug necessitates the use of protective release liners to cover the adhesive-containing surfaces until the plug is inserted in the base cut-out. The removal of these liners and accurate placement of the adhesive-coated plugs are time consuming manufacturing procedures.

OBJECTS AND SUMMARY OF THE INVENTION

Accordingly, it is an object of the invention to reduce and obviate the aforementioned disadvantages that have been evidenced in the art.

It is another object of the invention to improve interpin insulation in the tube-base combination.

Yet another object of the invention is to provide an improved insulation means that is easily and quickly incorporated into the tube-base combination.

These and other objects and advantages are achieved in one aspect of the invention wherein an improved insulation member, having discrete topographic features, is formed for facile incorporation into the tube-base combination to accomplish enhanced electrical insolation for at least one of the tube connective pins. It has been found that this discretely contoured insulating insert of the invention effect markedly improved arc reduction in the tube-base combination.

DESCRIPTION OF THE PREFERRED EMBODIMENTS

For a better understanding of the present improvement invention, together with other and further objects, advantages and capabilities thereof, reference is made to the following specification and appended claims in connection with the aforedescribed drawings.

Figure 1:
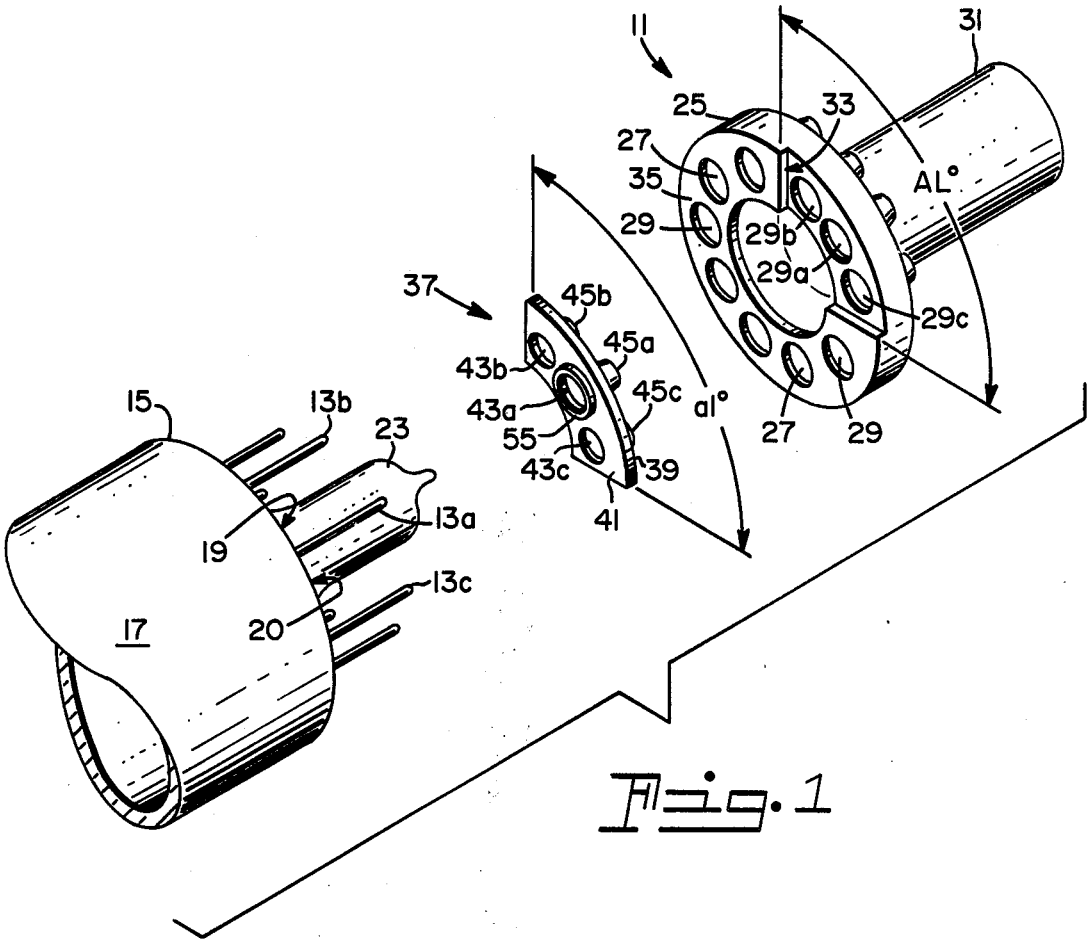
FIG. 1 is an exploded perspective view illustrating the manner in which the improved insulating insert member is associated with the tube and a base.

With reference to the drawings, there is shown in FIG. 1 an exploded presentation including a cathode ray tube base 11 formed to receive an annular array of connector pins 13 protruding from the terminal closure portion 15 of a cathode ray tube neck 17.

In greater detail, the drawings delineate the terminal closure portion 15 formed of a hermetically sealed, cylindrical glass header having a plurality of annularly spaced-apart connector pins 13 and **13*a* projecting therefrom. In this instance, the circle of pins has at least one pin 13*a* oriented with vacant pin positions 19 and 20 on either side thereof. Each pin and pin position is surrounded by an individually formed nubbin of glass, such as 21*a*, 21*b*, and 21*c*, (FIG. 5) raised from the header surface 15. The sealed exhaust tubulation 23 projects axially from the central area of the header 15**.

The base 11, which is seated contiguously against the tube closure header 15, is formed of a substantially flat, basic circular member 25 having a diameter in keeping with that of the cylindrical closure portion 15 of the tube. This basic member 25 includes a plurality of spatially-related pin receiving means 27 having tapered receiving openings 29 (see FIG. 5); such being annularly oriented to receive the pins **13, 13*a* . A hollow substantially centrally located crown 31 is an integral part of the basic member 25 oriented in a manner to accommodate the sealed exhaust tubulation 23** therein.

A cut-out 33 of the basic member 25 is indented inwardly from the surface 35 thereof facing the header 15. This cut-out 33 has a depth "d" less than the thickness "t" of base member 25. The length of the cut-out extends through a circumferential arc "AL°" and encompasses a plurality of pin receiving means 27 in the base member 11. In this instance, the cut-out portion 33 includes three pin receiving means 27 which, as illustrated, accommodates a group of three sequential nubbin positions 21*a*, 21*b* and 21*c* of the pin circle of the header 15. As exemplarly shown, the middle nubbin 21*a* of the group has a connector pin 13*a* protruding therefrom,which can be a high voltage connector pin, while the side-related nubbins 21*b* and 21*c* are vacant positions in the pin circle.

The purpose of the invention is to minimize the possibility of arcing between the pin 13*a* and the adjacent pins 13*b* and 13*c* on either side thereof. This result has been expeditiously achieved by the provision of an improved, resilient, insulating insert 37 formed in a substantially arcuate shape to fit into the cut-out portion 33 of the base 11. The insert has a thickness "T" that is slightly greater, as for example 0.50 mm., than the depth "d" of the cut-out 33 in the base; and an arcuate length "al°" slightly less, for instance 0.25°, than the arcuate length "AL°" of the cut-out 33. Such exemplarly dimensionings enable the resilient insert 37 to be advantageously compressed between the closure header 15 and the base 11. To enable such compression, the insert member is formed of a soft resilient material, evidencing, for example, a charateristic durometer hardness (Shore scale) substantially within the range of 20 to 40 points, as measured on a Durometer Hardness Tester (Type A2), manufactured by The Store Instrument and Manufacturing Co., Inc. 90-35 Van Wyck Expressway, Jamaica, N.Y. 11435. An example of a suitable material of this nature is silicone rubber. It has been found that a substance of this hardness can be beneficially compressed to fill-in or contiguously conform to the inherent roughness of the header surface, thereby further inhibiting the possibility of arcing thereacross.

Figure 2:
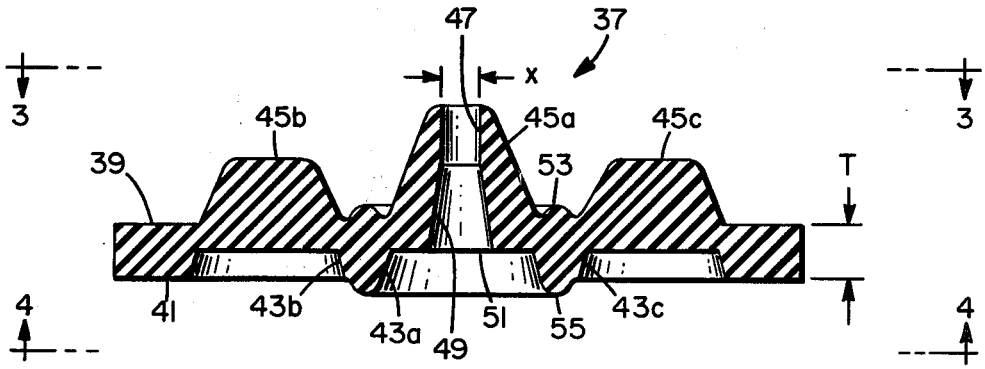
FIG. 2 is an elevational view of the improved insert member showing the advantageous topographical features thereof.
Figure 4:
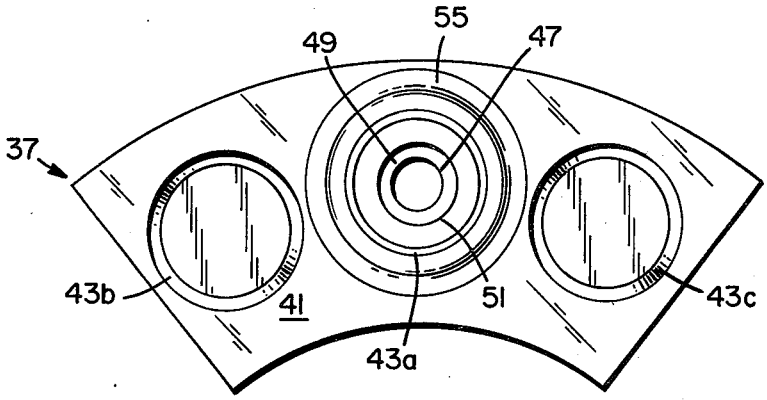
FIG. 4 is a plan view of the insulating insert member taken along the line 4—4 of FIG. 2.
Figure 5:
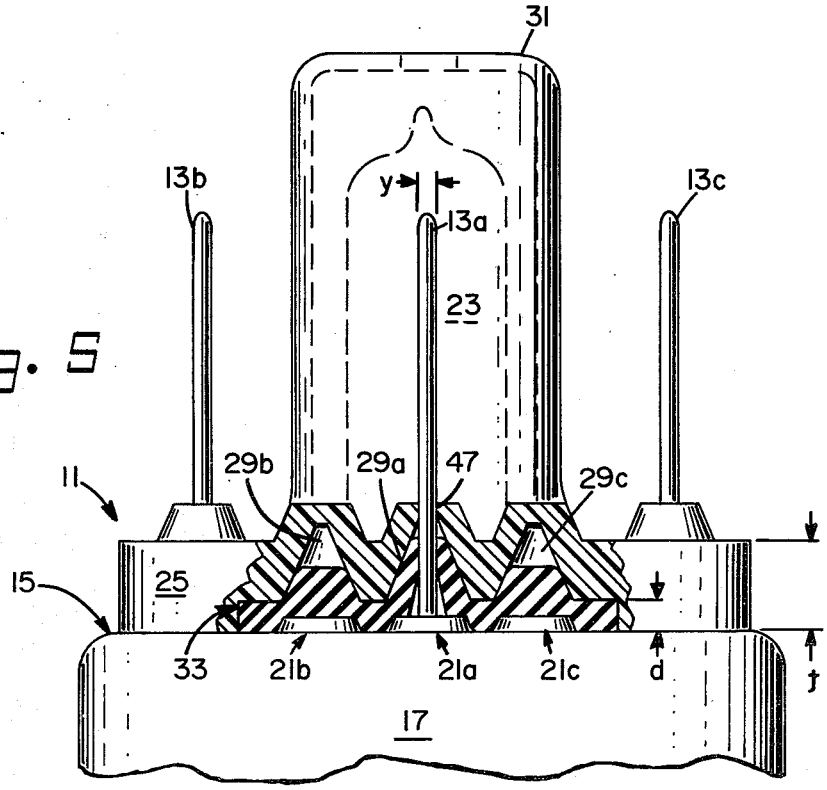
FIG. 5 is an elevational view, partially in section, illustrating the assembled tube-base combination having the improved insulating insert incorporated therein.

The insulating insert has opposed surfaces 39 and 41 of dissimilar topographic formations. For example, surface 39, as delineated in FIG. 2, has a plurality of protrusions outstanding therefrom, such being individually formed to mate with the respective tapered openings 29*a*, 29*b* and 29*c* in the base 11. The surface 41 of the insert, as illustrated in FIGS. 2, 4 and 5 has a plurality of shallow cavities 43*a*, 43*b* and 43*c* individually formed therein to contiguously accommodate the respective raised nubbin formations 21*a*, 21*b* and 21*c* on the header surface 15. The respective protrusions on surface 39 and the cavities associated with surface 41 are of like numbers and are located in opposite orientation as structural components of the insert 37.

Figure 3:
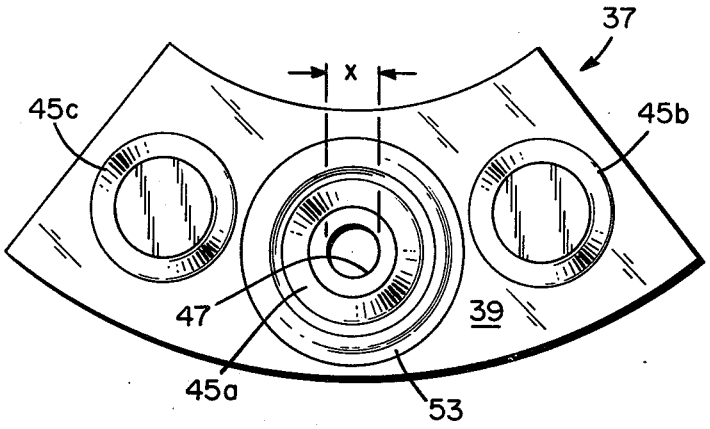
FIG. 3 is a plan view of the improved insert member taken along the line 3—3 of FIG. 2.

In greater detail, FIGS. 2 and 3 show three protrusions 45*a*, 45*b* and 45*c* from surface 39 whereof at least one, in this instance the middle one 45*a*, has an axial pin-encompassing aperture 47 therethrough, which has a diameter "x" that is less than the diameter "y" of the pin 13*a* positioned therein. This middle apertured protuberance 45*a* is substantially conical in formation and has a substantially tapered aperture entrance 49 ingressing from a central opening 51 in the bottom of the associated cavity 43*a* in the insert 37. The side related protuberances 45*b* and 45*c* are, for example, shaped as substantially conic frustums formed as solid appendages of the soft resilient material of the insert 37. Such formations are dimensioned to contiguously fit as resilient plugs into the tapered openings 29*b* and 29*c* in the cut-out portion 33 of the base.

Two other surface configurations integrally related with the insert 37 are of additional importance. Attention is directed to the middle conical protrusion 45*a* of the insert member, which is surrounded at its base by a raised annular compressible cushion 53 of material integrally associated with surface 39 of the insert. Substantially likewise, on the opposed side of the insert, the middle cavity 43*a* is peripherally circumscribed by a raised annular compressible cushion 55 of material integrally associated with surface 41. When the tube 17 and base 11 are assembled as shown in FIG. 5, these two annular cushions 53 and 55 are compressed to form two additional arc-inhibiting seals around the tube pin 13*a* contiguous with both the header 15 and the base 11.

In use, the insert 37 is positioned within the base cut-out portion 33 with the protursions of surface 39 being seated in the tapered openings 29*a*, 29*b* and 29*c* in the base member 11.

The base is then "capped" or assembled on the tube closure portion 15. The tube and base may be held together by the discrete application of an electrically insulating cement, or by frictional adherence means wherein several of the apertures in the base member are diametrically dimensioned to provide frictional affixation with the pins inserted therethrough.

It has been found that the improvement as set forth in this invention has markedly reduced the problem of inter-pin arcing in the tube-base combination of tubes wherein certain of the pins exhibit a high electrical potential difference therebetween.

While there has been shown and described what are at present considered the preferred embodiments of the invention, it will be obvious to those skilled in the art that various changes and modifications may be made therein without departing from the scope of the invention as defined by the appended claims.

What is claimed is:

1. In a cathode ray tube and contiguous base combination whereof the tube has a terminal closure portion formed of a hermetically sealed cylindrical header having a plurality of annularly spaced connector pins projecting therefrom to form a circle of pins wherein at least one of said pins has a vacant position on at least one side thereof, each of said pins and vacant pin positions being surrounded by an individual raised nubbin of glass at the header surface; said contiguous base portion of said combination being formed of a substantially flat basic circular member having a diameter in keeping with that of said cylindrical header, said base circular member including a plurality of spaced-apart pin receiving means having tapered receiving openings oriented in an annular manner in mating alignment with the pin circle of said header, said pins being accommodated through apertures in said respective pin receiving means; at least one tube pin isolating means including a cut-out portion of said basic member depressed inwardly from the surface thereof facing said header, said cut-out portion having a depth less than the thickness of said member and extending through a circumferential are encompassing a plurality of sequential pin-receiving means in said base member; and a resilient, electrically insulating insert formed in a substantially arcuate shape to fit said cut-out portion, said insert having a thickness greater than the depth of said cut-out portion and having opposite surfaces of dissimilar topographic formations, one of said surfaces of said insert member having a plurality of protrusions outstanding therefrom individually formed to mate with the respective tapered openings in said base member, at least one of said protrusions having an axial pin-encompassing aperture therethrough, and wherein the opposite surface of said insert member has a plurality of cavities individually formed therein to contiguously accommodate the respective nubbin formations on said header surface, said cavities and said protrusions being of like numbers and positioned in opposite orientation as structural components of said insert member, said cut-out portion in said base member accommodating a group of three sequential nubbin positions of the pin circle of said header, the middle nubbin of said group having a connector pin protruding therefrom and engaging said pin-encompassing aperture in said insert said side-related nubbins being vacant positions in said pin circle, said insert member having a group of three cavities and a group of three opposed protrusions, the middle protrusion of said group having a conical formation and containing said pin encompassing aperture, said side-related protrusions being formed as substantially conic frustums of solid elements of the soft resilient material of said insert, said apertured, conical, middle protrusion having a substantially tapered aperture entrance ingressing from a central opening in the bottom of the associated cavity in said insert, said middle conical protrusions of said insert being surrounded at its base by a raised annular cushion of material integrally associated with a surface of said insert.

2. The cathode ray tube and base combination according to claim 1 wherein the middle of said group of cavities is peripherally circumscribed by a raised annular cushion of material integrally associated with an opposite surface of said insert member.

3. The cathode ray tube and base combination according to claim 2 wherein the said insulating insert member is formed of a soft and compressive material exhibiting a characteristic durometer hardness (Shore scale) of substantially within the range of 20 to 40 points.

4. The cathode ray tube and base combination according to claim 3 wherein said insulating insert member is formed of a soft and compressive silicone rubber material.

* * * * *